US005340595A

United States Patent [19]

Cameron-Price

[11] Patent Number: 5,340,595

[45] Date of Patent: Aug. 23, 1994

[54] DRINKS CONTAINERS

[75] Inventor: Ernest J. Cameron-Price, Tanworth-in-Arden, England

[73] Assignee: E J Price (Development) Limited, England

[21] Appl. No.: 940,868

[22] PCT Filed: Feb. 21, 1991

[86] PCT No.: PCT/GB91/00272

§ 371 Date: Oct. 21, 1992

§ 102(e) Date: Oct. 21, 1992

[87] PCT Pub. No.: WO91/13006

PCT Pub. Date: Sep. 5, 1991

[30] Foreign Application Priority Data

Feb. 21, 1990 [GB] United Kingdom ..... 9003889.4
Oct. 25, 1990 [GB] United Kingdom ..... 9023260.4

[51] Int. Cl.[5] ..... B65B 31/00; B65D 17/00; B65D 25/00

[52] U.S. Cl. ..... 426/112; 206/222; 220/501; 220/505; 220/527; 220/553; 220/555; 426/115; 426/123; 426/131

[58] Field of Search ..... 426/112, 115, 123, 131; 206/222; 220/501, 505, 527, 553, 555

[56] References Cited

FOREIGN PATENT DOCUMENTS 227213 7/1987 European Pat. Off. .
2211813 7/1989 United Kingdom .

*Primary Examiner*—Leo B. Tentoni
*Attorney, Agent, or Firm*—Quarles & Brady

[57] ABSTRACT

Drinks cans are provided with a gas reservoir containing a gas to bubble into beer to initiate the production of further bubbles from gas dissolved in the beer, when the can top (4) is opened by pulling the ring-pull device (5). In the construction of FIG. 1, a plastics cap (8) is a tight snap fit on an annular rib (9) formed on the can base (3), the cap (8) being provided with a fine hole (10) through which nitrogen bubbles on opening of the can. In the construction of FIGS. 2 and 3, an unapertured blow-off cap (8) is fitted on an annular rib (15) formed on a partition wall (12) of the can, the cap normally covering fine holes (13) in the partition wall, air under super-atmospheric pressure in gas reservoir (13) bubbling into beer in the main chamber (6) when the cap blows off the rib (15) on opening of the can top.

6 Claims, 1 Drawing Sheet

DRINKS CONTAINERS

FIELD OF THE INVENTION

This invention relates to drinks containers of the kind comprising a cylindrical wall, first and second end walls at opposed ends of the container, one of the end walls comprising an area which is adapted to provide a non-resealable, normally-closed pouring opening to enable drink to be poured from the container. Such a container will hereinafter be referred to as a 'drinks container of the kind set forth'.

BACKGROUND OF THE INVENTION

Nitrogen is valuable in promoting a good head on beer. When the beer is sold in cans there is difficulty in introducing nitrogen into the beer, because nitrogen is relatively insoluble in beer as compared with the solubility of carbon dioxide. It has been proposed in specification no. EP 02 27 213A to provide a plastics nitrogen-containing vessel inside a can of stout at the bottom, with a small hole through which the pressurised nitrogen escapes when the can is opened. Whilst that proposal is feasible, it requires the manufacture of the special vessel which must then be retained in place at the bottom of the can in some way.

In specification GB 2,211,813 a drinks container of the kind set forth is described in which an independently formed partition wall is inserted into the container to partition the interior into a gas and a drinks chamber.

SUMMARY OF THE INVENTION

According to one aspect of the present invention, in a drinks container of the kind set forth a gas reservoir is defined between a cap and one of the end walls, said one end wall being formed with an annular rib which co-operates with the margin of the cap to retain the cap, and to effect an annular seal therewith, the cap being formed with one or more passage means to provide restricted communication between the gas reservoir and the main chamber, to enable gas under pressure in the reservoir to pass into drink in the main chamber When the pouring opening is opened.

The cap is preferably made of a plastics material and is arranged to have a snap-engagement with the rib. It is then an easy matter to assemble the cap to said one end wall by urging the cap against said one end wall.

When said one end wall is made of metal, the rib can be produced by a pressing and/or spinning operation. The pressing operation can form part of the deep-drawing process commonly employed with drinks cans to produce a can end wall integral with the cylindrical wall of the can.

A second aspect of the invention is concerned with maintaining a seal between a gas reservoir and a main drinks chamber in a drinks container of the kind set forth until just before it is desired to pour drink from, or to drink from, the container.

According to the second aspect of the invention, a drinks container of the kind set forth comprises a partition wall extending substantially parallel to the end walls and being positioned axially closer to the first end wall to define a gas reservoir between the partition wall and the first end wall, and to define a main drinks chamber between the partition wall and the second end wall, the second end wall comprising said area which is openable to provide the pouring opening, the partition wall being formed with an annular rib projecting from the wall in the direction towards the second end wall, and a resilient cap which is arranged to fit on the rib, and form an annular seal therewith, a passage means being provided in the partition wall within the area covered by the cap.

The fit of the cap on the rib is chosen such that when the container is opened by opening of the pouring opening, gas under pressure in the gas reservoir ejects the cap from the rib, and gas passes into the drink in the main chamber by way of the passage means.

Since the cap isolates the reservoir gas from drink in the main chamber until the container is opened, it is possible to employ in the reservoir a gas, such as air, which would produce deterioration of the drink if it were in permanent contact therewith.

The partition wall may be of metal or plastics, and when the partition wall is of metal the rib can be produced by a pressing or spinning operation.

The partition wall can simply be a tight fit with the cylindrical wall, for example as proposed in specification no. GB 2,211,813A.

Alternatively, the margin of the partition wall may be sealed into a junction between the cylindrical wall and the first end wall.

BRIEF DESCRIPTION OF THE DRAWINGS

The invention will now be further described, by way of example only, with reference to the accompanying drawings in which.

DETAILED DESCRIPTION OF EMBODIMENTS OF THE INVENTION

Figure 1:
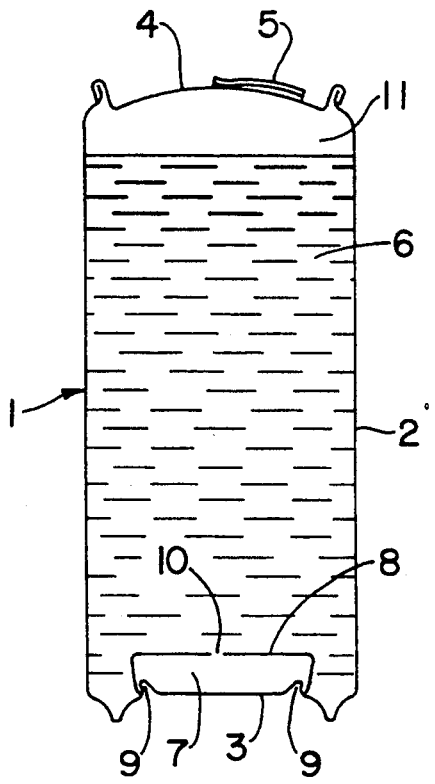
FIG. 1 is a vertical cross-section of a beer can in accordance with the invention, prior to opening of the can.

FIG. 1 shows a beer can 1 comprising a cylindrical aluminium alloy side wall 2 formed integrally, by deep-drawing, with a base 3, the upper end of side wall 2 being connected to a top 4 provided with a conventional ring-pull 5 for creating an opening in the top 4 when it is desired to pour out the drink contained in the main chamber 6 of the can.

A gas reservoir 7 is defined between the central region of base 3 and a plastics cap 8, the cap 8 having a tight snap-engagement with an annular rib 9 projecting inwardly of the can from base 3. Reservoir 7 is charged with nitrogen at super-atmospheric pressure prior to filling of the main chamber with beer containing dissolved carbon dioxide. A small hole of closely-control led dimensions in the cap 8 provides a restricted passage means between the reservoir 7 and the main chamber 6.

When the ring-pull 5 is operated to open the can top 4 the pressure in head-space 11 falls to atmospheric pressure, and carbon dioxide dissolved in the beer begins to come out of solution at suitable sites. Nitrogen issues into the main chamber from reservoir 7, and the bubbles produced provide nuclei for the development of carbon dioxide bubbles which rise to the surface of the beer to provide a head on the beer.

It will be appreciated that in the construction of FIG. 1, the engagement between the cap 8 and the rib 9 must be arranged to be sufficiently tight that the cap 8 is not blown away from the base 3 when the can top is opened.

Figure 2:
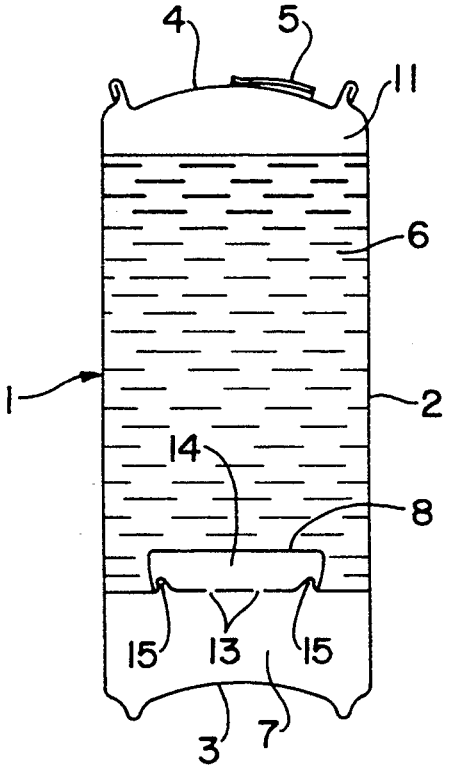
FIGS. 2 and 3 are vertical cross-sections of modified cans, prior to opening of the cans.
Figure 3:
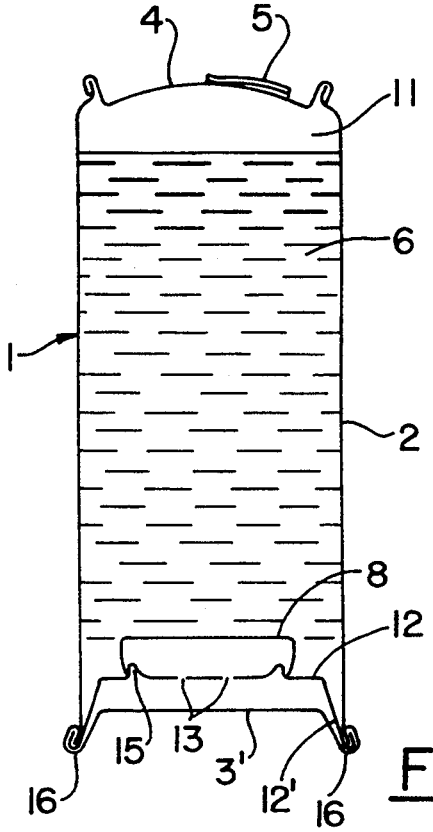

As distinct from the arrangement of FIG. 1, the modified cans of FIGS. 2 and 3 employ an arrangement in which a cap 8 is blown off its seating, an annular rib 15 provided on a partition wall 12, when the can is opened. Other parts corresponding to those of the can of FIG. 1 have been given corresponding reference numerals.

The can of FIG. 2 is a can of substantially conventional construction but in which a partition wall 12 has been inserted.

The central region of partition wall 12 is formed with a plurality of holes 13 of carefully-controlled dimensions to provide a passage means between the reservoir space 7 and the main chamber 6 when the cap 8 has been unseated from rib 15 by the differential pressure between cap-chamber 14 and the main chamber 6 when the ring-pull 5 is operated.

In the can of FIG. 2 the partition wall 12 is an interference fit within the can whereas in the modification of FIG. 3 the margin $12^1$ of the partition wall 12 is rolled into the rolled connection 16 between the base $3^1$ and the lower side wall 2. The partition wall 12 in FIG. 3 is conveniently formed as a plastics moulding with integral rib 15.

I claim:

1. A drinks container comprising a cylindrical wall (2), first and second end walls (3, 4) at opposed ends of the container, one of the end walls (4) comprising an area (5) which is adapted to provide a normally-closed pouring opening to enable drink to be poured from the container, wherein a gas reservoir (7) is defined between a cap (8) and one of the end walls (3), said one end wall being formed with an annular rib (9) which co-operates with the margin of the cap to retain the cap, and to effect an annular seal therewith, the cap being formed with one or more passage means (10) to provide restricted communication between the gas reservoir and the main chamber (6), to enable gas under pressure in the reservoir to pass into drink in the main chamber when the pouring opening is opened.

2. A drinks container as claimed in claim 1 , wherein the cap is made of a plastics material and is arranged to have a snap-engagement with the rib.

3. A drinks container comprising a cylindrical wall (2), first and second end walls (3, 4) at opposed ends of the container, one of the end walls (4) comprising an area (5) which is adapted to provide a normally-closed pouring opening to enable drink to be poured from the container, wherein a partition wall (12) extends substantially parallel to the end walls and is positioned axially closer to the first end wall (3; $3^1$) to define a gas reservoir (13) between the partition wall and the first end wall, and to define a main drinks chamber (6) between the partition wall and the second end wall (4), the second end wall comprising said area (5) which is openable to provide the pouring opening, the partition wall being formed with an annular rib (15) projecting from the wall in the direction towards the second end wall, and a resilient cap (8) which is arranged to fit on the rib, and form an annular seal therewith, a passage means (13) being provided in the partition wall within the area covered by the cap, and the fit of the cap on the rib being chosen such that when the container is opened by opening of the pouring opening, gas under pressure in the gas reservoir ejects the cap from the rib, and gas passes into the drink in the main chamber by way of the passage means.

4. A drinks container as claimed in claim 3, wherein the gas in the gas reservoir is air.

5. A drinks container as claimed in claim 1, wherein the partition wall is of metal and the rib has been produced by a pressing or spinning operation.

6. A drinks container as claimed in claim 1, wherein the partition wall is an independently formed member and is a tight fit with the cylindrical wall.

* * * * *